US005895007A

United States Patent [19]

Moller et al.

[11] Patent Number: 5,895,007

[45] Date of Patent: Apr. 20, 1999

[54] METHOD AND DEVICE FOR WINDING A PAPER WEB TO FORM A REEL

[75] Inventors: Roland Moller, Herbrechtingen; Ralf Preising, Holzkirch; Karl Ruck, Heidenheim; Christian Schiel, Murnau, all of Germany

[73] Assignee: Voith Sulzer Papiermaschinen GmbH, Germany

[21] Appl. No.: 08/919,698

[22] Filed: Aug. 28, 1997

[30] Foreign Application Priority Data

Aug. 30, 1996 [DE] Germany ..... 19635216

[51] Int. Cl.[6] ..... B65H 18/10; B65H 18/16; B65H 19/26

[52] U.S. Cl. ..... 242/527.2; 242/532.2; 242/541.1; 242/541.5; 242/542.3; 242/547

[58] Field of Search ..... 242/527.2, 527.3, 242/532, 532.2, 532.3, 541.1, 541.4, 541.5, 541.6, 541.7, 542.3, 547

[56] References Cited

U.S. PATENT DOCUMENTS

| | | | |
|---|---|---|---|
| 1,923,670 | 8/1933 | Henson et al. . | |
| 3,844,501 | 10/1974 | Spencer | 242/527.2 |
| 4,153,215 | 5/1979 | Schulze | 242/527.3 |
| 4,184,648 | 1/1980 | Mergell | 242/532 |
| 4,204,650 | 5/1980 | Mengel | 242/532.2 |
| 4,491,283 | 1/1985 | Pav et al. | 242/547 |
| 4,842,209 | 6/1989 | Saukkonen | 242/527.3 |
| 5,249,758 | 10/1993 | Müller et al. . | |
| 5,251,835 | 10/1993 | Kyytsonen | 242/541.1 |
| 5,445,341 | 8/1995 | Martin et al. | 242/527.3 |
| 5,556,053 | 9/1996 | Henseler | 242/541 |
| 5,577,685 | 11/1996 | Junk | 242/547 |
| 5,647,555 | 7/1997 | Conrad et al. | 242/547 |
| 5,732,902 | 3/1998 | Tomma et al. | 242/541.5 |

FOREIGN PATENT DOCUMENTS

| | | |
|---|---|---|
| 0483092 | 4/1992 | European Pat. Off. . |
| 1513694 | 1/1968 | France . |
| 3244510 | 10/1983 | Germany . |
| 4007329 | 9/1991 | Germany . |
| 4401959 | 7/1994 | Germany . |
| 29611251 | 10/1996 | Germany . |
| 1297812 | 11/1972 | United Kingdom . |

*Primary Examiner*—John M. Jillions
*Attorney, Agent, or Firm*—Ostrolenk, Faber, Gerb & Soffen, LLP

[57] ABSTRACT

A method and device for winding a paper web to form a reel. The web is wound onto a shell that is predominantly centrally driven to introduce a torque that winds the web on the shell into a reel. A pressure element extends over the width of the web and acts continuously on the outer surface of the reel being wound in order to squeeze out air. A web threading roll comes adjacent the shell during web threading. Once the web is threaded, the shell is moved generally horizontally from the web threading toward the main winding position where the web is wound. A compensation device supports the reel being wound. The first pressure element in contact with the reel may move away, and a second pressure element closer to the compensation device may press upon the reel, after the first pressure element has moved away.

24 Claims, 7 Drawing Sheets

METHOD AND DEVICE FOR WINDING A PAPER WEB TO FORM A REEL

BACKGROUND OF THE INVENTION

The invention relates to a method and a device for winding a running paper web to form a reel. The following prior art are relevant:

(1) DE 40 07 329

(2) DE 32 44 510

(3) FR 15 13 694

(4) GB 12 97 812

(5) U.S. Pat. No. 1,923,670

(6) EP 0 483 092 A1

Winding machines for winding paper webs are arranged either at the end of a papermaking machine, to wind the paper web accumulating there into a reel, or they are also used for rewinding a finished reel in order to produce reels with a quite specific winding quality.

In every case, the roll is intended to have quite specific properties, particularly related to the winding hardness. The winding hardness is intended to fall from a specific starting value to a final value, as a hard core winding is particularly important at the beginning. The decrease in hardness is intended to be as uniform as possible from the first to the last wound layer. The decrease is intended to have a specific gradient, that is to not be too severe or too weak. The profile of the winding hardness is intended in no case to have jump points, i.e., a sudden drop. No radial or tangential stresses should occur in the roll which might impair or destroy the paper web.

All this has previously been sought, but not achieved. Known winding machines instead produce, for example, rolls in which the core is either extremely soft or extremely hard and also in which there is a sharp drop in the winding hardness toward the end of the winding, at about four-fifths of the roll diameter. The first part, that is, the extremely soft or hard core, is unusable, specifically because the web suffers longitudinal compression in this region and splits. This part of the web has to be discarded as broke. In the final end region, in which the roll is not wound sufficiently hard, there is lateral displacement of the layers in relation to one another, so that the ends of the finished reel have a frayed appearance and the web edges can easily be damaged.

A poorly constructed core, with too low or too great a hardness, specifically does not allow satisfactory construction of the rest of the roll. The problem is particularly serious for pressure sensitive papers, for example, for self copying (NCR) papers. For these papers, close limits are placed on the pressing of the shell, with the roll being produced which is located on the shell, against the outer surface of the carrier drum.

SUMMARY OF THE INVENTION

The object of the invention is to provide a method and a device for winding a running paper web, such that the winding hardness has the desired profile from the start to the end of the wound reel, that is, the winding hardness is under control at every instant during the winding process. In addition, of course, the expense for the machinery is to be kept as low as possible.

The inventors hereof have recognized that deficient quality of wound web rolls produced on known winding machines relates back to a series of interfering influences. These are, in detail: pivoting of the shell or core on which the web is wound along the circumference of a carrier drum as winding starts; shock-like placement of the shell which has started to be wound onto the guide track; shocks and hence irregularities, caused by the transfer of the shell from the primary arm pair to the secondary arm pair; irregularities when changing the drives. A decisive finding is based on the fact that combining various types of drive is disadvantageous, namely combining a central drive and a circumferential drive of the reel being produced. The inventors have accordingly concentrated on the central drive, which is most important for controlling the build-up of the winding hardness. As a result of centrally applied torque, a "wound-in" web tension is produced, which is completely continuous and which can be kept constant or can be continuously altered during the entire winding process. Hence, no jump points occur in the web tension, so that the winding hardness during the entire winding process may be kept under control, in that it can be set to any desired value. In addition, the invention enables a new shell to be placed, shortly after the shell change, into a position (for example on a horizontal guide track) which subsequently makes a controlled shell change possible. Nevertheless, the new shell initially has no contact with the web, and it therefore initially does not need to be driven. Overall, this makes it possible for a shell change to take place at any desired time, if necessary, for example in the case of an exceptional faulty winding start, and/or also as long as the paper reel is not yet full.

When a paper reel with a particularly large diameter is to be formed, then it is advantageous to support the paper reel being produced during the winding process using a reel weight compensation device which is of flat design, so that it acts on the outer surface of the reel over a specific portion of the circumference rather than just along one line. Hence, the application of a noticeable line force is in general avoided, and hence also the unsteadiness which accompanies such line forces.

The invention provides for the paper web to be wound onto a shell predominantly or exclusively by a centrally introduced torque, for example, by means of a central drive. At least one pressure element or squeezing element extends over the web width and acts continuously on the reel being produced in order to squeeze out air.

In a development of the method, the weight of the reel being produced and of the shell can be compensated, at least during part of the winding process, by a force which engages on the outer surface of the reel and acts over the web width, the so-called compensation force. The compensation force preferably acts over a circumferential area and compensates the inherent weight of the reel and of the shell.

In a development of the method, at the beginning of the winding process, the shell or core on which the web is to be wound and a web threading roll are brought close and parallel to each other in a winding start position. The web is led to the web threading roll, so that the web wraps over a certain circumferential angle around that latter roll, led around through the gap between the shell and web threading roll and is wound up on the shell. A first pressure element extends over the web width and acts on the reel being produced. After the reel has started to be wound in the winding start position, according to this embodiment of the method, it is brought into a main winding position for further winding, for example, by horizontal movement of the shell. In the main winding position, the reel is then wound until it is finished. At least one further pressure element acting on the outer surface of the reel being produced.

In a development of this method, when the reel is in the main winding position, the first pressure element, which already acts on the reel in the winding start position, is brought out of contact with the reel. Care is taken that prior to moving the first pressure element outward, at least one further pressure element is acting on the outer surface of the reel, so that at least one pressure element extending over the web width acts on the web width during the entire winding process to squeeze out air.

In a preferred embodiment of the method, the compensation device for applying the compensation force acts on the reel only in the main winding position and is moved vertically with the reel, corresponding to the growth of the reel, for example, it is moved vertically downward.

In general, there are three possible, preferred variants of the inventive method. In a first variant, the reel being produced is moved on a path with a horizontal component, and the central drive for the shell follows this horizontal movement, particularly guided by a carriage.

In an alternative embodiment, the reel being produced may be fixed in the main winding position, together with the central drive, such that with increasing reel diameter, the pressure elements which are in contact with the reel are the components which move on a path having a horizontal component. Thus, in this embodiment, a first pressure element moves away from the reel being produced as the reel diameter increases. In a final stage, the first pressure element is brought out of contact with the wound reel. However, by contrast, a further pressure element comes into contact with the reel with increasing reel diameter and remains on the reel, until the winding process is completed. That contact by the further pressure elements should begin after the first pressure element is out of the contact with the wound reel.

The amount of machinery involved is kept low by the following aspects of the method. The compensation device comprises a pressing element which both supplies a compensation force for at least a part of the winding process and also serves as a or as the further pressure element. Therefore, the further pressure element comprises a pressing element which also applies compensation force for supporting the wound reel.

For the compensation device to always supply an adequate supporting force when the shell moves horizontally, a special embodiment of the compensation device, executes horizontal movement together with the shell and the reel being produced.

After the web has been threaded, the shell with the reel being produced should move horizontally away from the web threading roll. After the horizontal movement has begun, the first pressure or squeezing element is pivoted into its operating position.

In addition to the method, the invention also provides a device for winding a paper web to form a reel, wherein the reel has a shell on which the web is wound. A central drive predominantly or exclusively applies winding torque to the shell. In addition, the device comprises at least one squeezing or pressure element which extends over the web width. In this case, at least one squeezing element is arranged in the region where the web runs onto the reel being produced, and serves to squeeze out air.

A compensation device may predominantly or solely compensate the weight of the reel being produced and the weight of the shell. That device engages the outer surface of the reel.

A web threading roll is brought into a position parallel to and close to the shell.

In a preferred winding device, after winding has been started, the reel being produced is moved a distance, which has a horizontal component, into a position at which the main winding process is carried out. A carriage and a guide track guide the carriage during that horizontal movement.

The compensation device is moved in the vertical direction by appropriate means as a function of the growth of the reel, for example, it is moved vertically downward. If the shell and the reel being produced on it move in the horizontal direction, it is advantageous if the compensation device follows them, i.e. it is also moved in the horizontal direction.

A particularly cost effective design includes the compensation device comprising a pressing device which both acts as a compensation device and hence relieves the growing reel, and as a further pressure or squeezing element which serves to squeeze out air from the winding reel.

In a particular configuration, the compensation device has a circulating supporting belt which, for example, wraps around two carrier rolls of the compensation device. It is particularly advantageous if the compensation device has a sliding shield, e.g. in the form of an endless belt, which is arranged inside the loop of the supporting belt and over which the supporting belt slides.

Other features and advantages of the present invention will become apparent from the following description of the invention which refers to the accompanying drawings.

BRIEF DESCRIPTION OF THE DRAWINGS

FIGS. 1–4 illustrate schematically a first embodiment of the invention, wherein FIG. 1 shows the machine at threading;

FIG. 2 shows the initial winding position;

FIG. 3 shows the conditions near changeover to the next winding shell;

FIG. 4 shows threading on the next shell;

FIGS. 7–11 schematically illustrate a third embodiment, wherein

FIG. 7 shows the start of winding;

FIG. 8 shows the main winding process;

FIG. 9 shows the reel winding just before it has been completed;

FIG. 10 shows the completed reel winding;

FIG. 11 shows the condition after winding a reel is completed and before a new winding process begins;

FIGS. 13 and 14 schematically illustrate a fourth embodiment, wherein

FIG. 13 shows the condition before reel change; and

FIG. 14 shows the condition after reel change and FIG. 14 also shows a slightly modified version of the FIG. 13 embodiment.

DESCRIPTION OF PREFERRED EMBODIMENTS OF THE INVENTION

Figure 3:
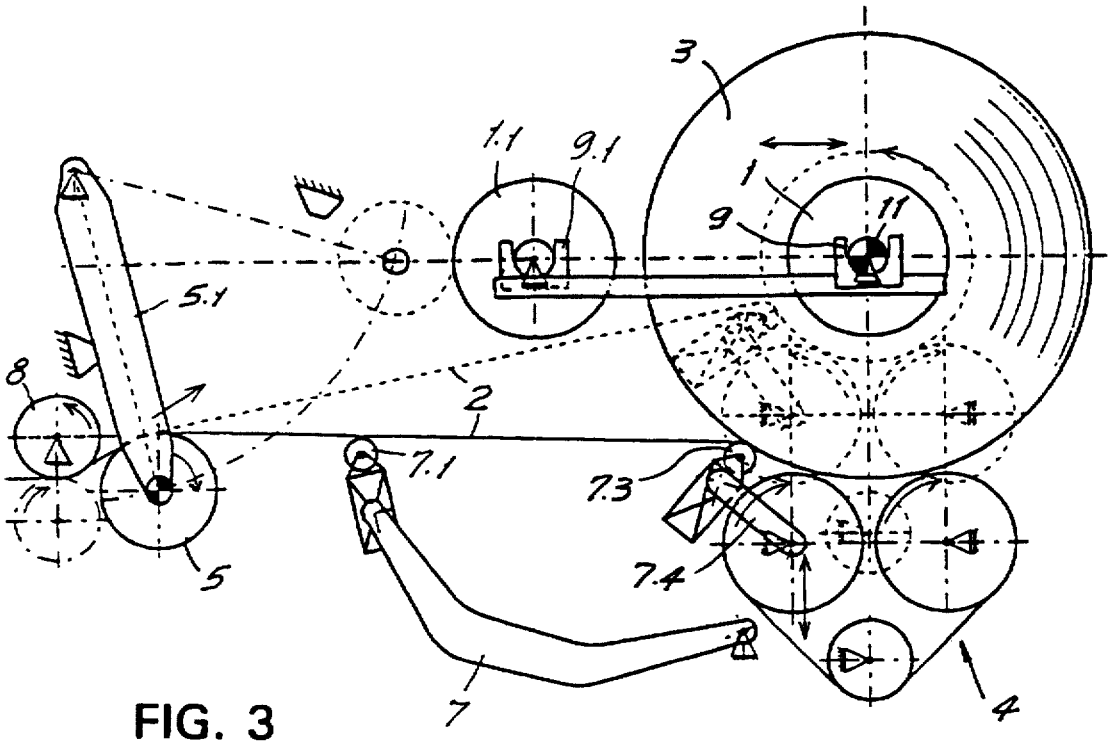

There is a shell or core 1 onto which a paper web 2 is to be wound to form a wound reel 3 (FIG. 3).

There is a drivable reel weight compensation device 4, which comprises a circulating belt 4.1 and three guide rolls 4.2, 4.3 and 4.4 for that belt. The belt and the guide rolls extend over the width of the reel 3 being produced, and the reel sits on the belt which wraps over a portion of the circumference of the reel.

A drivable web threading roll 5 is supported on the swingable end of a pivoting arm 5.1. The arm 5.1 pivots the web threading roll until it contacts the shell 1. After threading, the roll 5 is pivoted away from the shell 1 again. The shell 1 is rotatably mounted in support in carriages 9. The carriages can be moved on a generally horizontal path along a guide track 6 which extends over some distance, e.g. horizontally. The guide track 6 also carries a further carriage for a central drive for the shell, shown schematically at 11. The central drive introduces torque into the center of the shell 1 for winding the paper web 2 on the shell.

A pivoting arm 7 supports a web squeezing element 7.1 on the free end of the arm. The element 7.1 is here a roll which is either freely rotatable or is provided with a rotation drive.

Further construction features and operation of the device are now described.

Figure 1:
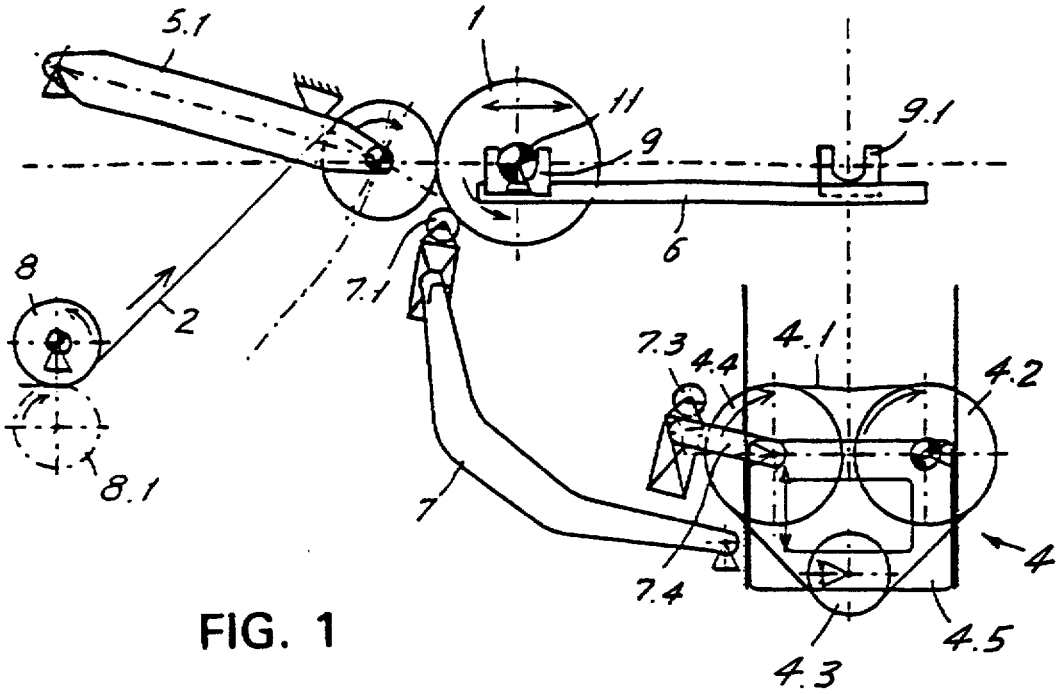

At the left in FIG. 1, there is a web guide roll 8. This may optionally be engaged by a mating roll 8.1, which can be pressed by a lever and a pneumatic system against the guide roll 8. The rolls 8 and 8.1 in this case constitute a draw press, which can also be driven.

FIG. 1 illustrates the start of winding and the transfer process. The shell 1 is inserted into the carriages 9 and is accelerated to machine speed. The web threading or transfer roll 5, is pressed against the shell 1. A paper web 2 is led from the guide roll 8 from below to the web threading roll 5, is wrapped around the roll 5 and is then led through the press nip between the shell 1 and web threading roll 5. By means of air blast nozzles not illustrated, the web is wrapped around the shell 1 enabling winding the web on the shell.

Figure 2:
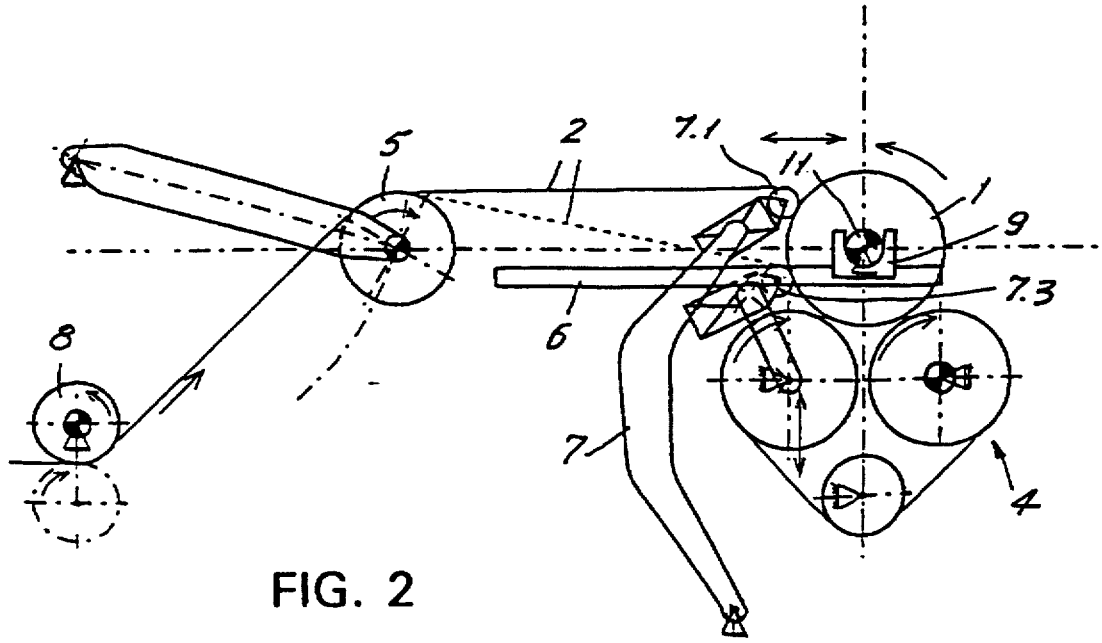

After web winding has started, the shell with the wound on start of the web 2 is moved to the right in FIGS. 1 and 2 into the horizontal location above the compensation device 4 in FIG. 2. The actual web winding process is performed here, as seen in FIGS. 2 and 3. In this case, the winding is caused solely by the illustrated central drive 11 of the shell.

In FIG. 3, the compensation device 4 moves vertically down during the main winding process as the reel 3 enlarges. The device 4 was initially in the upward position shown in dashed lines, while the continuous lines show the lowered position of the compensation device 4 toward the end of the winding process. The compensation device preferably applies its support over a circumferential region of the wound reel, rather than merely having line contact across the reel.

During the main winding process, the pivoting arm 7 supporting the air squeezing roll 7.1 starts by pressing against the roll 3 and against the web 2 and pivots backward, to the left and downward, as seen in FIG. 3. Replacing the squeezing roll 7.1, a further squeezing roll 7.3 on a much shorter pivoting arm 7.4 is pivoted against the paper reel 3 by that arm. The winding web is thus always contacted by a squeezing roll, either 7.1 or later 7.3.

The pivoting swing movement of the roll 7.1 is enabled by the .space which is created by the horizontal movement of the shell 1 along with the reel 3 being produced. The web threading roll 5 and the associated pivoting arm 5.1 supporting that roll at its end are likewise pivoted downward during the winding process, as seen in FIG. 3. Thus, at any desired time, a new shell 1.1 can be inserted into another carriage pair 9.1 as seen in FIG. 3. In this case, the new shell temporarily remains out of contact with the paper web 2. Therefore, during this time, it does not yet need to be driven.

One of the two carriages 9 for the shell then being wound and 9.1 for the shell to be wound runs on the outside of the guide track 6, whereas the other carriage runs on the inside on the guide track 6. This is necessary in order that the two carriages be able to pass by each other so that each carriage in turn can be moved from the shell receiving to the reel winding positions and then back again. See, for example, DE 44 01 804.

Figure 4:
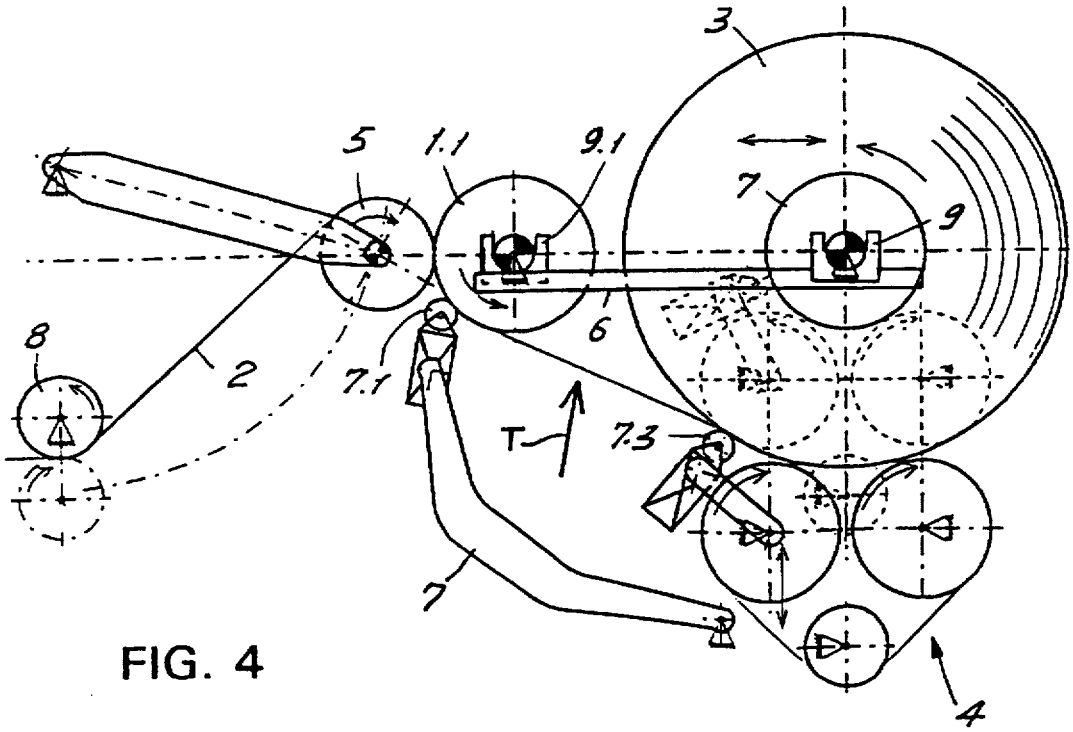

FIG. 4 illustrates the situation shortly before the shell change. The web threading roll 5 and the squeezing roll 7.1 are both pivoted up against the new shell 1.1. and the new shell 1.1 is now being driven. A severing device (arrow T) can now sever the web transversely, so that the newly formed web end can be wound onto the new shell 1.1. The fully wound paper reel is thereafter braked and then removed from the device. This is followed by the next winding process, as described above with reference to FIGS. 2–4.

The flat supporting device considered is, for example, a device as described in DE 44 18 900 A1 and shown in FIG. 2 thereof.

Figure 5:
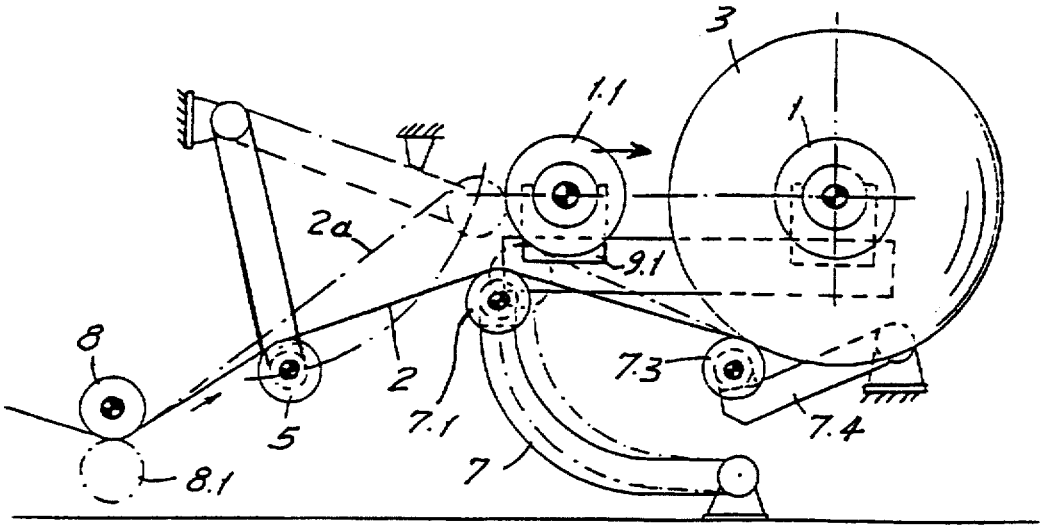
FIG. 5 schematically illustrates a second embodiment while the machine is running regularly and before the shell for receiving a wound web is changed.
Figure 6:
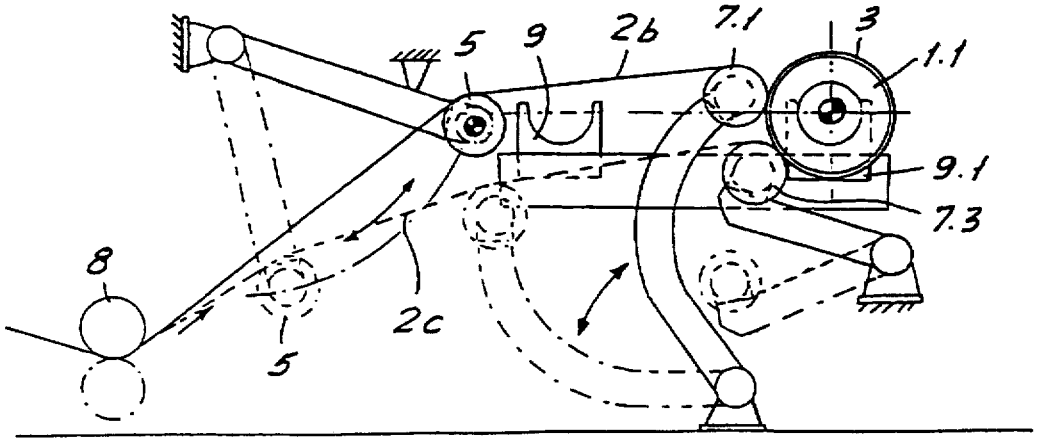
FIG. 6 shows the second embodiment after the shell is changed.

FIGS. 5 and 6 illustrate a further embodiment of a winding machine which has essentially the same components as the first embodiment of a winding machine.

FIG. 5 illustrates the normal run of the web 2 in continuous lines. This machine is shown in the state similar to FIG. 3. The new shell 1.1 is in this case already supported in the carriages 9.1, but is then still at a standstill, without being in contact with the web 2.

The chain-dotted lines in FIG. 5 shows the course of the web 2*a* shortly before a reel change. At this time, shell 1.1 is rotating.

FIG. 6 illustrates two further phases of the winding operation. The paper web 2*b* is shown after the reel change by continuous lines. The finished reel 3 (FIG. 5) has already been removed. The new shell 1.1, on which winding has already started, has been displaced together with its carriages 9.1 into the (right-hand) winding position. The two squeezing rolls 7.1 and 7.3 are resting against the new shell. The dashed lines indicate the web 2*c* in the normal running condition, analogous to FIG. 3. In this case, the rolls 5 and 7.1 have been pivoted downward.

FIGS. 7 to 11 illustrate a further embodiment of a winding machine according to the invention.

A pivotable arm 7 is provided, which carries both a pressure roll 7.1 and a shell 1 on which the web is wound. The roll 7.1 is urged by a spring or the like along the arm 7, which serves as the carriage for the roll 7.1, and is urged against the finished reel 3. A web threading roll 5' is mounted in a fixed position and the shell 1 is swung toward and away from the roll 5.

A second pressure roll 7.3 is supported for being moved horizontally on a guide track. It is urged along that track to engage the wound roll, especially after the pressure roll 7.1 separates from the roll.

The relief device 4 is configured analogously to that device 4 in FIGS. 1 to 4. Here too, a guide roll 8 is arranged at the inlet to the winding machine, possibly also cooperating with a pressure roll 8.1, which forms a draw press with the roll 8.

Figure 7:
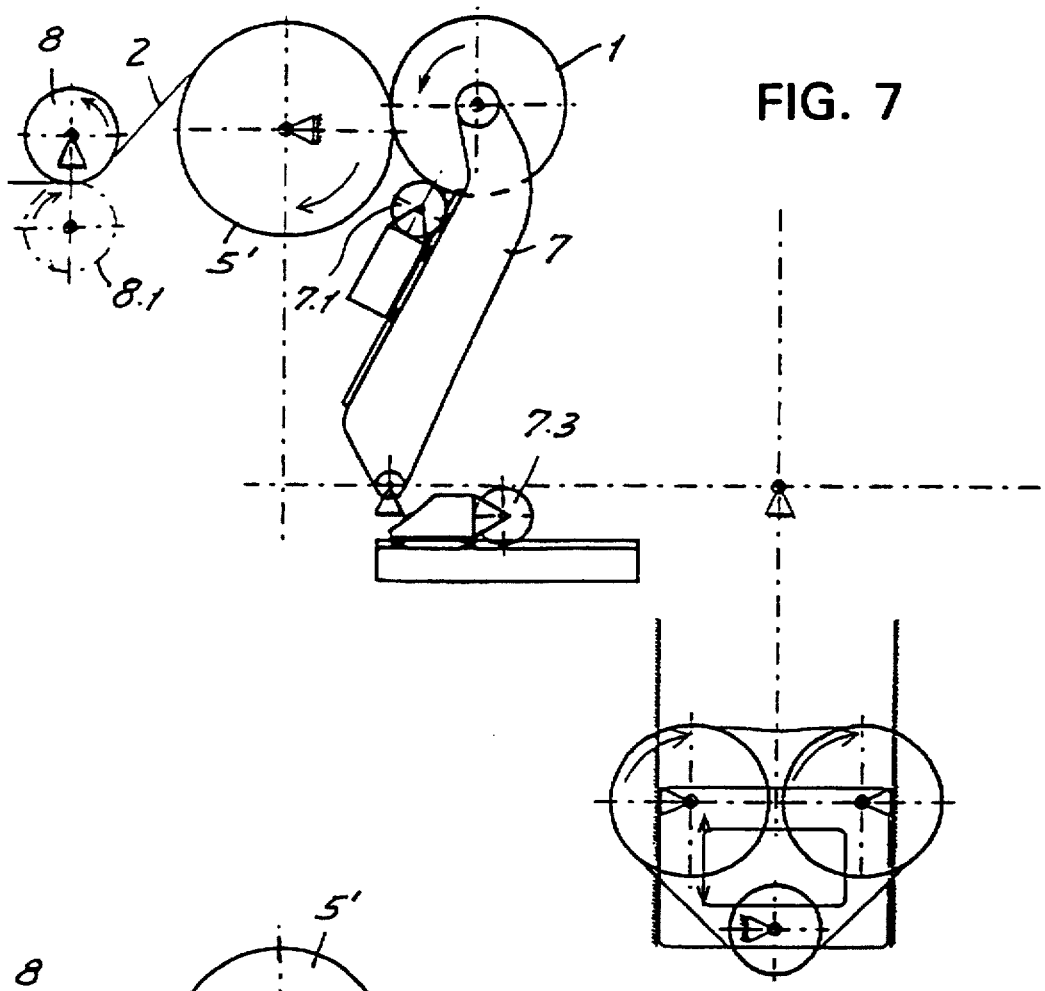

FIG. 7 shows the machine in the phases of threading and where it is starting to wind the paper web 2 onto the shell 1.

Figure 8:
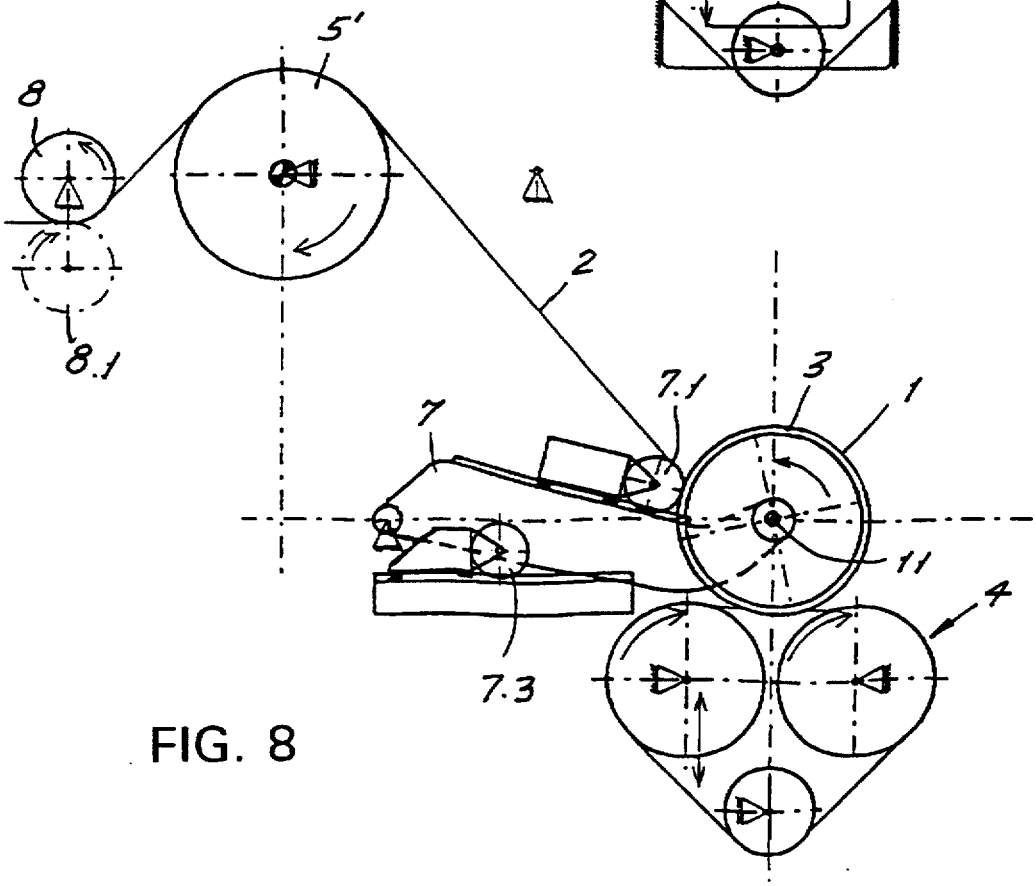

FIG. 8 shows the winding machine during the main winding process. Pivotable arm 7 with shell 1 and pressure roll 7.1 has now been lowered in such a way that support for the roll being wound onto the shell is provided by the relief device 4. The main part of the winding operation is carried out with the individual parts in this position.

Figure 9:
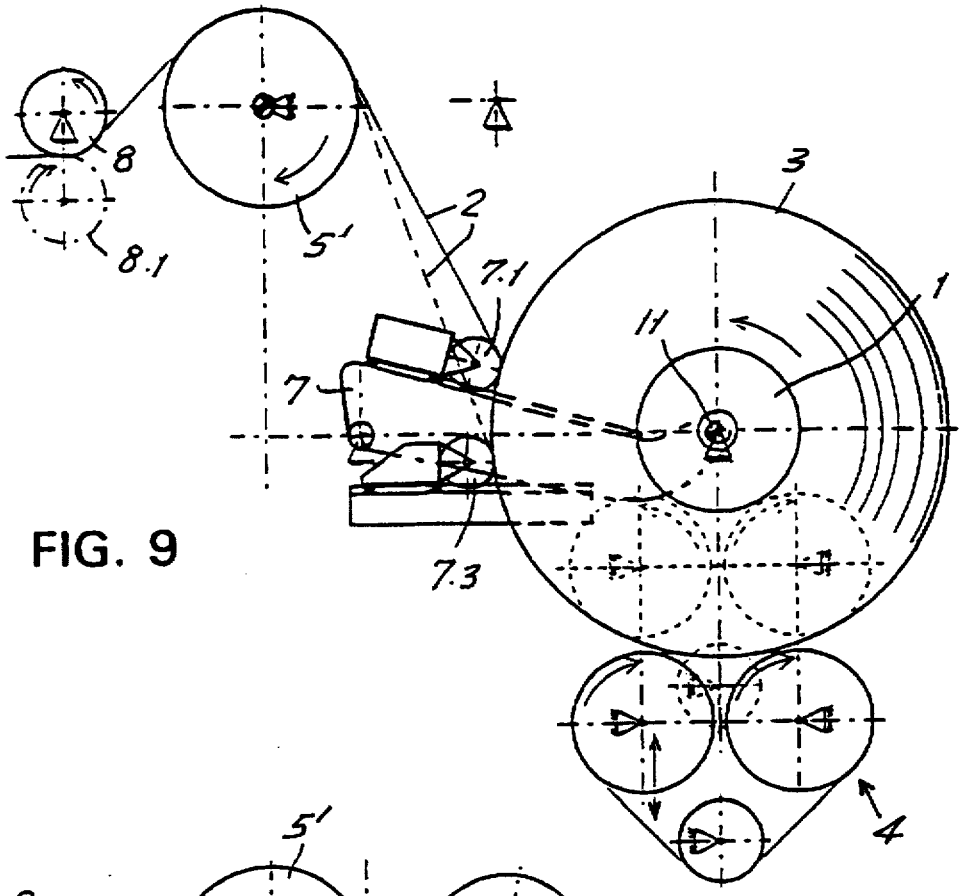

FIG. 9 shows the situation shortly before the main winding process finishes. In this case, the pressure rolls are also changed. Specifically, the upper pressure roll 7.1 is moved along the pivoting arm 7 away from the paper reel 3, while the lower pressure roll 7.3 engages against the circumference of the paper reel 3.

Figure 10:
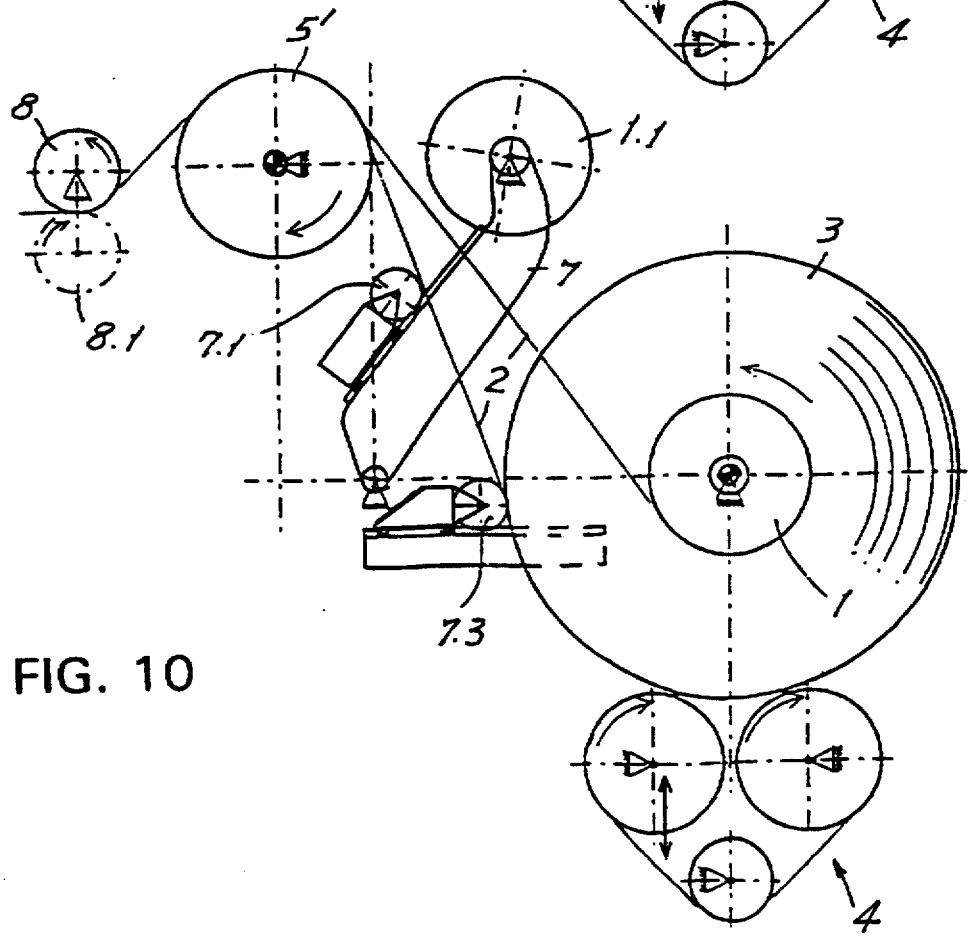

FIG. 10 shows the situation when the winding process has been completed. The paper roll 3 is now finished. Pivoting arm 7 with pressure roll 7.1 is pivoted up leaving the wound roll on the device 4. The new shell 1.1 is inserted into the pivoting arm 7, but the shell is still stationary (no contact with the web).

Figure 11:
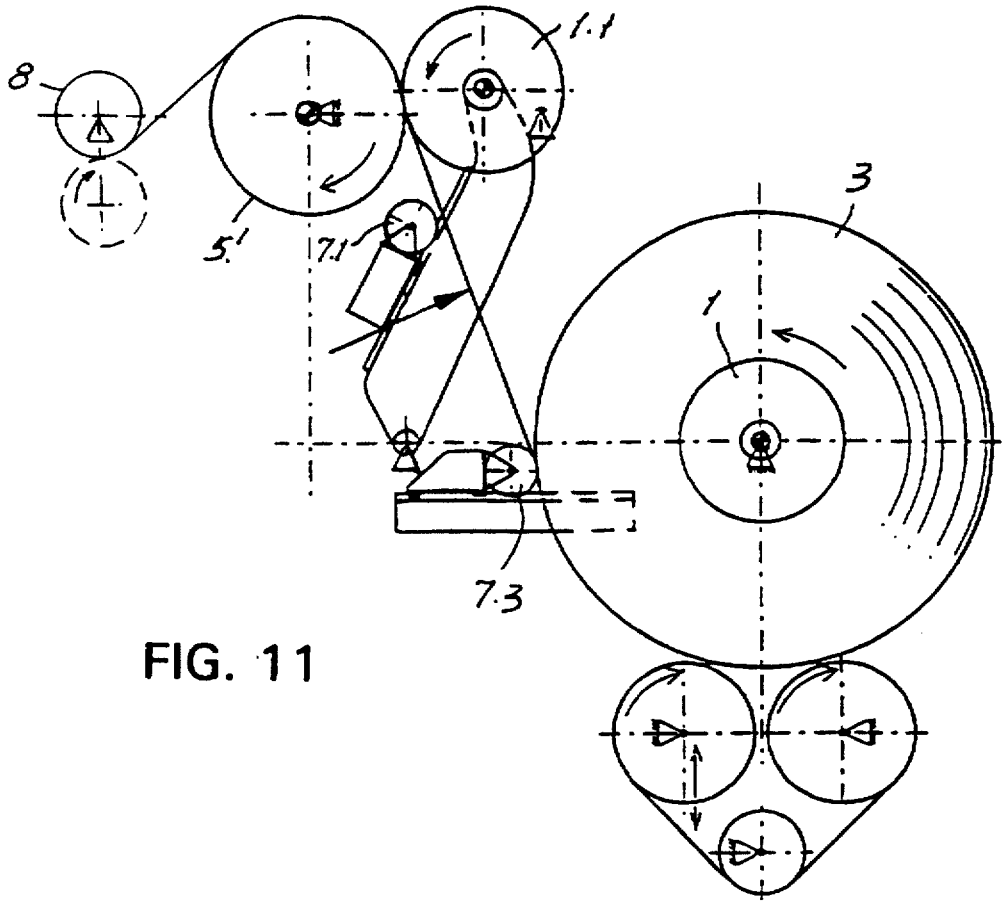

In FIG. 11, the pivot arm 7 has been pivoted away from the paper reel 3 to such an extent that shell 1.1 is resting on the web threading roll 5'. A severing device, which is symbolized by an arrow, severs the web 2, after which a new winding process begins.

Figure 12:
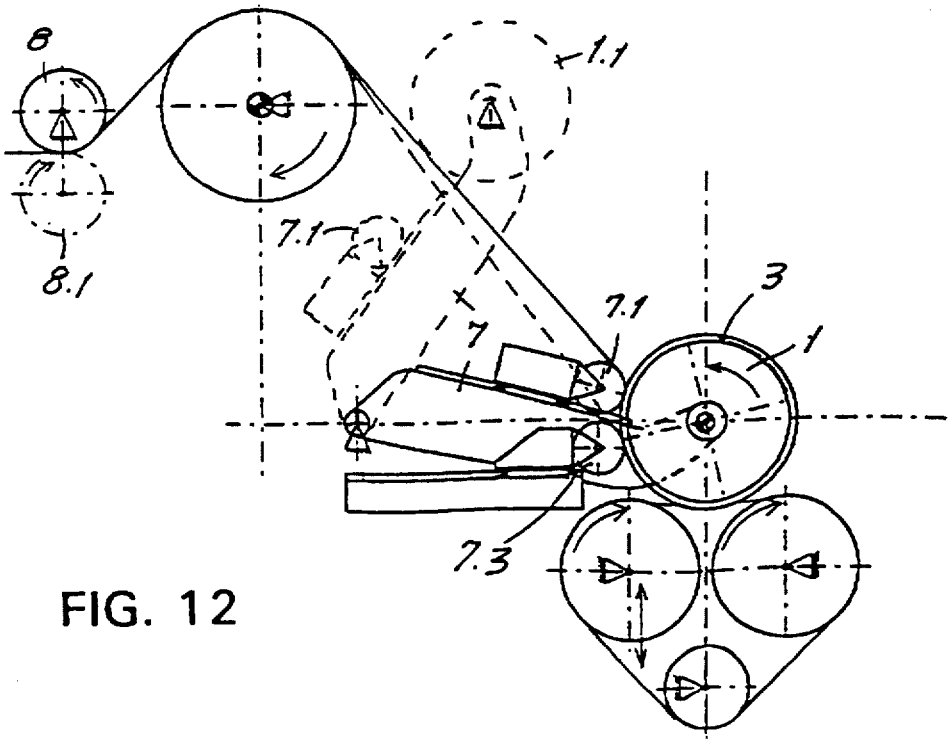
FIG. 12 shows a slightly modified version of the third embodiment.

FIG. 12 represents an embodiment of a winding machine which is similar to that according to FIGS. 7 to 11. However, the change from the first to the second one of the two pressure rolls 7.1 and 7.3 is made at a very small diameter of the reel 3. This enables very early insertion of a new shell 1.1.

Figure 13:
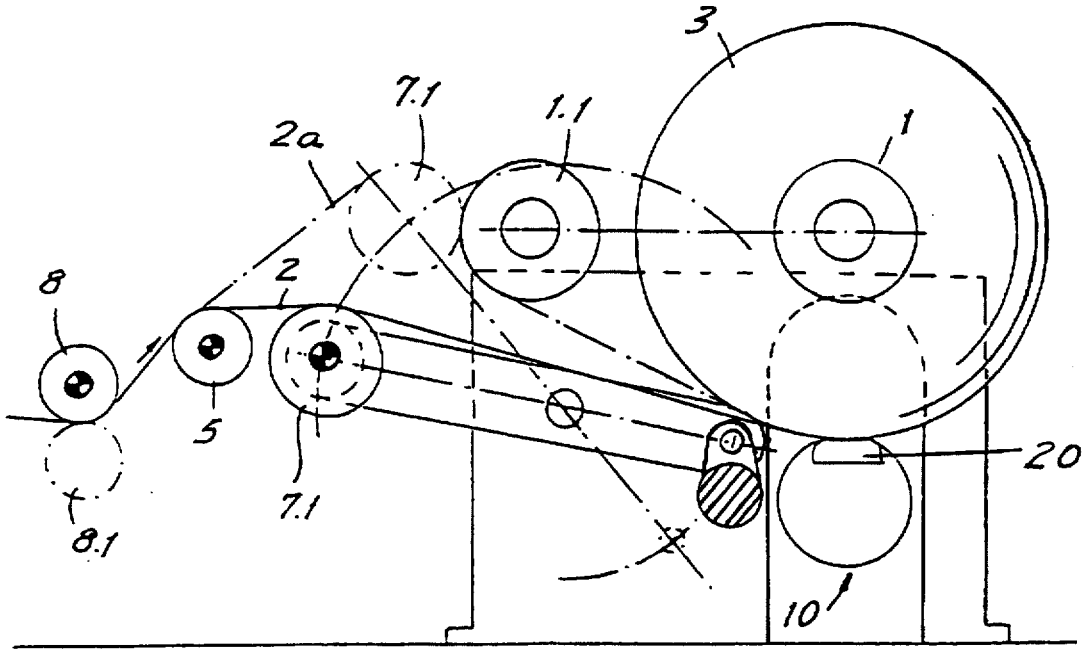
Figure 14:
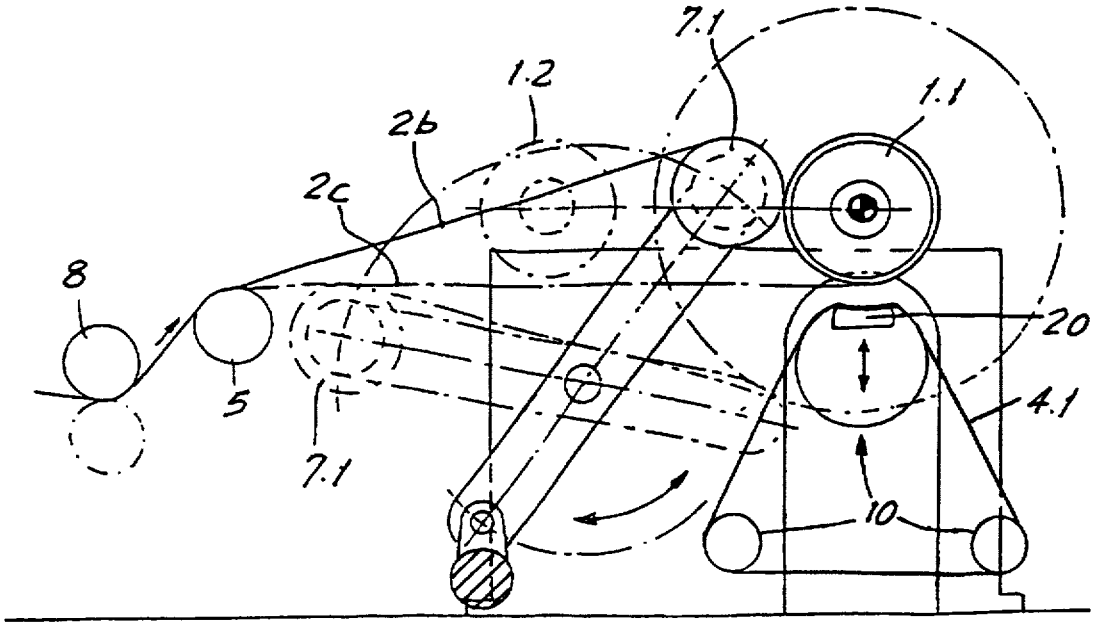

FIGS. 13 and 14 show an embodiment which has distinct differences from the previous embodiments.

In both Figures, the travel path of the paper web is drawn both with continuous and with broken lines. In FIG. 13, the continuous web run 2 illustrates the normal web run to the paper reel 3 that is being wound on shell 1. In this case, the next shell 1.1 is still stationary. The chain-dotted web run **2*a* shows the web run shortly before the reel change. In this case, the next shell 1.1** is rotating.

In FIG. 14, the web run **2*b* in solid lines is present shortly after the reel change, whereas the web run 2*c* illustrates the normal web course, which is illustrated with continuous lines in FIG. 13. In this case, the next shell 1.2** can already be inserted.

An important difference between the machine in FIGS. 13 and 14 and the previous embodiments is that a device 10 is provided which is constructed in the manner of a shoe press with a shoe 20, which is known, for example, from DE 3 503 240. The device 10 assumes the function of relieving the weight of the reel 3 and, at the same time, performs the function of the pressure roll 7.3. That device 10 applies its compensation force not as a line force, but over a circumferential region of the reel.

A modified embodiment of the machine according to FIG. 13 is illustrated in FIG. 14. In this embodiment, a circulating belt 4.1 surrounds the compensation device.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for winding a paper web on a first shell to form a first reel, the device comprising:

a first shell onto which the first reel is to be wound; a central drive for the first shell which at least predominantly applies torque to the first shell for winding the web on the first shell;

a web threading roll movable to the first shell at start of winding of a web on the first shell;

a first pressure applying element extending over the width of the web and being arranged in the region where the web has run onto the first reel being produced, and first means for urging the first pressure applying element against the surface of the first reel for squeezing air out of the first reel;

a second pressure applying element also extending over the width of the web and also being arranged on the region where the web has run onto the first reel, and second means for urging the second pressure applying element against the surface of the first reel also for squeezing air out of the first reel;

a second shell on which a second reel is to be wound after winding of the first reel on the first shell;

the first pressure applying element also being movable away from the first reel being wound and being movable against the second shell spaced away from the first shell and on which a second reel is to be wound after the first reel is wound and while the second pressure applying element continues to apply pressure to the first reel, whereby movement of the first pressure applying element to the second shell does not discontinue application of pressure to the first reel.

2. The device of claim 1, further comprising a compensation device for at least predominantly compensating for the weight of the first reel being wound and for the weight of the first shell, the compensation device being positioned to engage on the outer surface of the first reel.

3. The device of claim 2, wherein the compensation device acts over a circumferential area of the outer surface of the first reel being produced larger than line contact.

4. The device of claim 1, further comprising a web threading roll normally separated from the first shell and movable to be oriented parallel to the first shell and close to the first shell during the web threading process, and means for moving the web threading roll close to the first shell.

5. The device of claim 4, further comprising means supporting the first reel to be moved a distance on a path with a horizontal component from the web threading position which is toward the web threading roll to a main winding position at which the web winding continues until the first reel is wound.

6. The device of claim 5, further comprising a carriage on which the first shell is supported and is movable generally on a path with a horizontal component, the central drive being also supported on the carriage, the first shell and the central drive being movable on the carriage along the path with a horizontal component.

7. The device of claim 6, further comprising a compensation device for at least predominantly compensating for the weight of the first reel being wound and for the weight of the first shell, the compensation device being positioned to engage on the outer surface of the first reel.

8. The device of claim 7, wherein the compensation device is supported for vertical movement with reference to the carriage and corresponding to the enlargement of the first reel as it is wound.

9. The device of claim 8, wherein the compensation device is movable generally on the path with a horizontal component along with the first shell and the first reel.

10. The device of claim 8, wherein the compensation device further comprises and serves as a pressing device that presses against the first reel for squeezing air from the first reel.

11. The device of claim 8, wherein the compensation device includes a circulating support belt, and means supporting the belt to circulate and to contact with the first reel being wound so that the belt moves with the first reel being wound.

12. The device of claim 11, further comprising a sliding shoe inside the loop of the support belt and over which the support belt slides.

13. A method of winding a paper web to form a reel, the method comprising:

rotating a shell at least in part by a centrally introduced torque, the shell being in a winding start position;

bringing a web threading roll close to and parallel to the shell in the winding start position;

leading the web to and wrapping the web around the threading roll over a circumferential angle and leading the web through the gap between the shell and the web threading roll;

then winding the web onto the shell;

applying a first pressure continuously against the outer surface of the reel being wound across the width of the web for squeezing air out of the reel as the web is wound on the reel;

moving the reel on which winding has started from the winding start position into a main winding position and away from the threading roll for further winding;

winding the reel to completion; and bringing at least a second pressure into engagement with the surface of the reel at least about the time of the completion of the winding of the reel and removing the first pressure out of contact with the reel while applying the second pressure onto the surface of the reel, wherein the first and the second pressures are applied by moving respective first and second pressure elements against the surface of the reel.

14. The method of claim 13, further comprising: applying a third pressure on the surface of a second shell on which a second reel of the web is to be wound after removing the first pressure out of contact with the reel and while the second pressure is still applied onto the surface of the reel.

15. The method of claim 13, further comprising compensating for the weight of the shell and for the weight of the reel being wound on the shell during the winding process by applying a compensating force engaging on the outer surface of the reel over the width of the web.

16. The method of claim 15, wherein the compensation force acts over a circumferential area larger than line contact on the reel and the force at least predominantly compensates for the inherent weight of the reel being produced on the shell.

17.The method of claim 15, wherein the compensating force applied to the reel also serves as the second pressure.

18. The method of claim 15, further comprising the reel being movable along a path having a horizontal component from the winding start position to the main winding position;

the compensation element and the shell and the reel being produced all execute the generally horizontal movement together.

19. The method of claim 15, wherein a compensation device for applying the compensating force on the reel acts on the reel in the main winding position.

20. The method of claim 19, further comprising moving the compensation device vertically corresponding to the growth of the reel in the main winding position.

21. The method of claim 15, further comprising the reel being movable along a path having a horizontal component from the winding process start position to the main winding position.

22. The method of claim 21, wherein the centrally introduced torque of the reel follows the horizontal movement of the reel.

23. The method of claim 13, wherein with the reel being at the main winding position, as the reel is wound and as the diameter of the reel increases, the pressure elements which are in contact with the reel move generally in a direction having a horizontal component.

24. The method of claim 13, wherein after the web is threaded, the shell with the reel being wound moves generally horizontally away from the web threading roll; and the first pressure is applied against the reel after the horizontal movement of the reel.

* * * * *